United States Patent [19]

Church

[11] 4,141,403

[45] Feb. 27, 1979

[54] GARAGE-PATIO DOOR

[76] Inventor: Rocco L. Church, R. D. 5, N. Division St. Rd., Auburn, N.Y. 13021

[21] Appl. No.: 916,269

[22] Filed: Jun. 16, 1978

[51] Int. Cl.[2] ..... E05D 15/24; E05D 15/38

[52] U.S. Cl. ..... 160/201

[58] Field of Search ..... 160/113, 201, 209; 16/63, 66, 71, 74, 75, 76, 77

[56] References Cited

U.S. PATENT DOCUMENTS 3,927,709 12/1975 Anderson et al. ..... 160/201

*Primary Examiner*—Peter M. Caun

*Attorney, Agent, or Firm*—Bruns & Jenney

[57] ABSTRACT

An overhead garage door comprised of a plurality of hinged sections at least one of which is provided with a series of window openings. Each window opening has an openable window sash and window screen therein whereby the garage can be well vented without admitting insects or unwanted animals. Means on the garage door operate to releasably retain the window sash in both its open and closed positions, and means in the garage structure coact with the door to automatically close any open windows whenever the door is raised to its overhead position.

9 Claims, 6 Drawing Figures

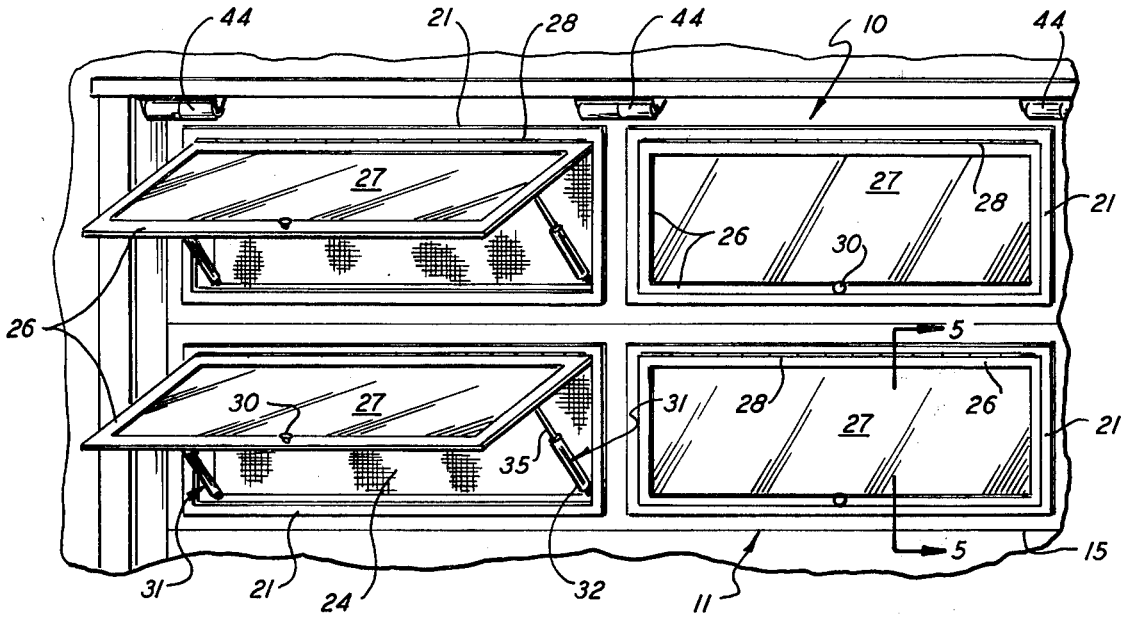
FIG. 3
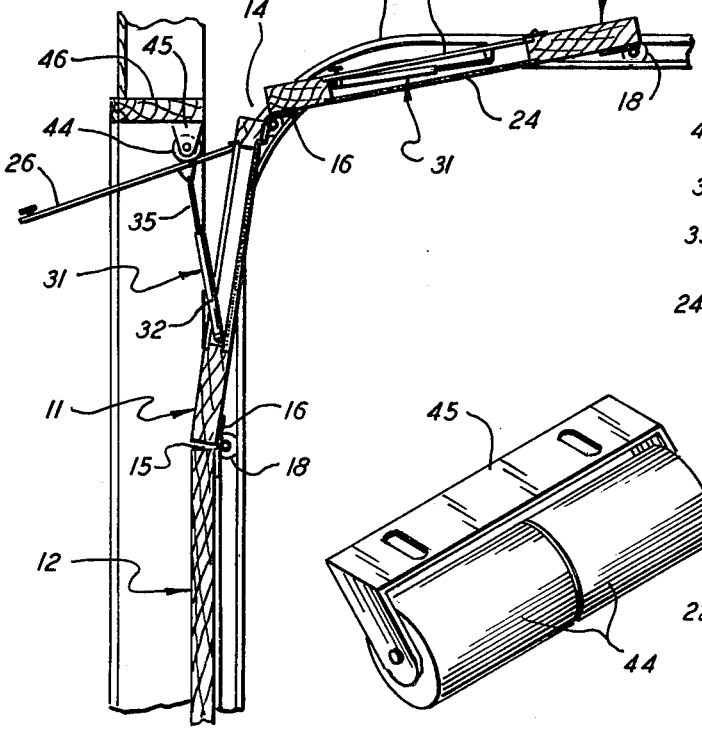
FIG. 4
FIG. 6
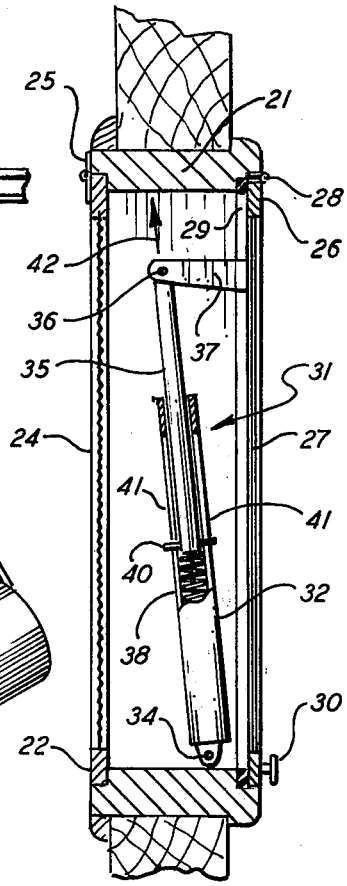
FIG. 5

GARAGE-PATIO DOOR

BACKGROUND OF THE INVENTION

This invention relates generally to garage door constructions, and has particular reference to an overhead garage door having a novel vent window arrangement and automatic window closing means operable when the door is raised to its overhead position.

The desirability of using a garage as a warm weather patio or as an extra room for any purpose has led to various garage door closures that depart from the conventional. In most instances, garages that are used in this manner were originally equipped with the usual overhead doors and in one type of modified closure the original door is kept in its overhead or raised position and the door opening is occupied by screening in some form. Thus, the screening may be in the form of a roll down curtain or it may be supported by a rigid frame or frames. Screening used in this way prevents normal use of the overhead door, and when normal use of the door is resumed the screening roll or frames must be stored.

Another type of closure for a garage that is to be used as a patio or the like consists of an overhead door that has been modified to include a plurality of window openings for providing increased ventilation and light for the garage interior. Such openings are usually provided with window screens and openable window sash. Overhead doors modified in this manner are disclosed in U.S. Pat. Nos. 3,178,776 and 3,927,709, and these patents represent the closest prior art known to the applicant.

SUMMARY OF THE INVENTION

The garage door of the invention is particularly well adapted to enable a garage to be utilized as a patio, a summer porch or an enclosed play area for small children in inclement weather. At the same time, the door can be raised and lowered in a normal manner and there is no need for additional equipment that at times would have to be stored.

The garage door disclosed herein is comprised of a plurality of elongated sections hingedly connected to one another along their long edges. At least one of the sections has a plurality of openings or apertures therethrough with a frame surrounding each opening. Mounted in each frame are a window screen and a window sash and pane that can be moved outwardly from a closed to an open position. Coacting with the frame and window sash for each opening is a spring biased linkage that operates to releasably retain the sash in both its open and closed positions. An advantageous feature of the invention is a means for automatically closing any windows that may be open when the garage door is raised to its overhead position.

With the garage door closed and its windows open, the interior of the garage can be well ventilated and can receive a substantial amount of natural light. At the same time, a degree of privacy can be maintained and insects and unwanted animals can be kept out.

BRIEF DESCRIPTION OF THE DRAWINGS

FIG. 3 is an enlarged, fragmentary perspective view of the door as viewed from outside the garage;

FIG.4 is an enlarged vertical sectional view through the door illustrating the operation of the automatic window closing means;

FIG. 5 is an enlarged vertical sectional view through one of the door windows taken on line 5—5 in FIG. 3; and FIG. 6 is an enlarged perspective view of one of the window closing rollers.

DESCRIPTION OF THE PREFERRED EMBODIMENT

Figure 1:
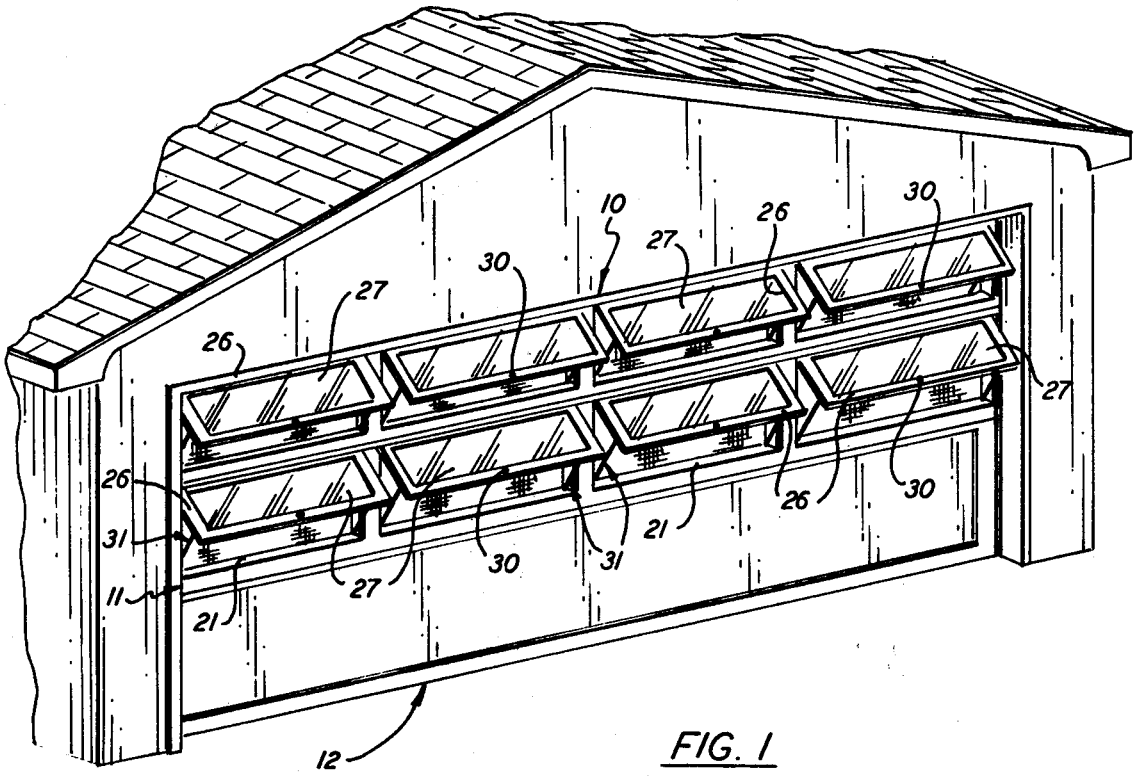
FIG. 1 is a perspective view of the front portion of a garage having a door embodying the invention, the windows of the door being shown in open position.
Figure 2:
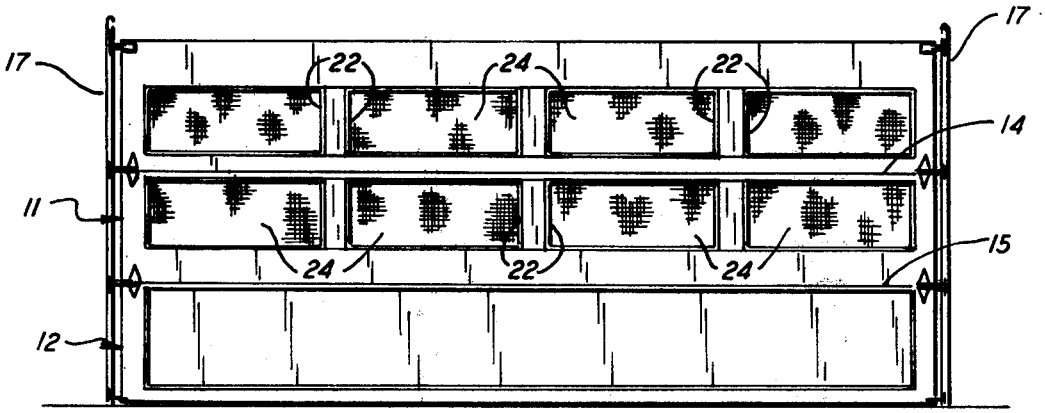
FIG. 2 is an elevation of the door as viewed from the inside of the garage.

Having reference now to the drawings, and with particular reference to FIGS. 1 and 2, the door is of the overhead type meaning that it is opened by raising it to an overhead position in a well known manner. The door comprises three elongated sections 10, 11 and 12 that are connected together along adjacent longitudinal edges 14 and 15 by suitable hinges 16, FIG. 3. The door is guided in its raising and lowering by guide tracks 17, FIG. 2, which receive door mounted rollers 18, FIG. 3, the tracks and rollers being substantially conventional.

In accord with the invention, the upper two door sections 10 and 11 are provided with a series of uniformly sized window openings each of which has a surrounding frame 21. A window screen comprising a frame 22 and screening 24 is mounted in each frame 21 on the inner side thereof, or the side facing the garage interior. The screen can be connected to the frame by hinges as shown at 25 in FIG. 5, or it can be completely removable being held in place by latches (not shown) of a known type or by a friction fit.

On the outer side of each window frame 21 there is mounted a closure member in the form of a window sash 26 and pane 27. The sash is connected along its upper edge to the frame as by a piano type hinge 28, FIGS. 3 and 5, whereby the window can be opened by pushing or pulling the lower portion thereof outwardly. This can be accomplished from inside the garage by swinging the screen out of the way, and from outside of the garage by pulling on a knob 30, FIGS. 1 and 3. When the window is in closed position, the sash 26 engages weatherstripping 29, FIG. 5, to effect a seal.

Each of the windows 26–27 is provided with means for releasably retaining the window in both its closed and open positions. This means comprises a pair of spring biased telescoping assemblies 31 connecting the sides of the window sash 26 to the sides of the window frame 21 as can be best seen in FIG. 3. The assemblies 31 are identical and each includes a tubular member 32, FIGS. 3–5, that is pivotally connnected at 34 to the side of the window frame and a rod 35 that is pivotally connected at 36 to a bracket 37 on the side of the sash. The free end of rod 35 is telescopically received in the tubular member and a compression spring 38 is positioned in the member between its closed lower end and the free end of the rod. Separation of the rod and tubular member is prevented by a cross pin 40 in the free end of the rod, the ends of the pin projecting outwardly through two diametrically opposite, longitudinal slots 41 in the tubular member as shown in FIG. 5.

The locations of the pivot points 34 and 36 of each assembly 31 are such that the telescoping tubular member and rod 32,35 are obliquely disposed with respect to the main plane of the window frame when the window is closed; see FIG. 5. With the window in this position, rod 35 extends a substantial distance into the tubular member and spring 38 is almost fully compressed. This results in an upward force on the rod as indicated by the arrow 42 and this in turn produces a clockwise moment of force about the window hinge 28 which tends to keep the window closed without the addition of latches or fasteners.

When the window is pushed or pulled outwardly to open it, the upper pivot point 36 moves from a point inside the window frame 21 (FIG. 5) to a point outside thereof (FIG. 4). The outward movement of the window is aided by spring 38 pushing rod 35 outwardly and the same spring force operates to releasably retain the window in open position. The outward movement of the window is limited by the engagement of pin 40 with the upper ends of the tubular member slots 41, FIG. 5. From the foregoing description it should be apparent that the assemblies 31 have an over center type of action that releasably retains the window in both closed and open positions without the need for additional hardware.

If the door is raised to its overhead position when one or more windows have inadvertently been left open, it will be apparent that the windows will be broken or otherwise damaged. To prevent such damage, means are provided for automatically closing any open windows as the door is being raised. This means consists of a series of spaced rollers 44, FIGS. 3, 4 and 6, the mounting btackets 45 for which depend from the top rail 46 of the garage door frame. As indicated in FIG. 3, the rollers 44 are mounted so that, other than the extreme left and extreme right roller, each one is adapted to engage the sides of two adjacent sash. The extreme left roller, as may be seen, engages only the side of the extreme left sash while the extreme right roller (not shown) engages only the extreme right sash.

FIG. 4 best shows how the rollers 44 operate to close the windows as the door moves upwardly. As the roller starts to engage the lower part of a window, the upper pivot points 36 of the assemblies 31 move over center and into the window frame 21 whereby the springs 38 take over and exert moments of force as previously described causing the window to snap shut. It will be understood that if the windows were held open by a positive latch means the rollers could not operate as described, such operation only being possible because of the releasable retaining action of the assemblies 31. While not shown, a suitable piece of molding or valance board can be provided to shield the rollers from the weather and from view.

The lower section 12 of the door can be made with decorative panelling or, if desired, this section can be provided with windows like the two sections above.

From the foregoing description it will be apparent that the invention provides a novel and advantageous garage door that is particularly adapted to enable the garage to be utilized as a patio or summer porch. As will be understood by those familiar with the art, the invention may be embodied in other specific forms without departing from the spirit or essential characteristics thereof.

I claim:

1. In a garage structure, a garage door comprised of a plurality of hinged sections, the door being movable between a substantially vertical closed position and a substantially horizontal open position, at least one of the door sections having a plurality of openings therethrough, a closure member for each of said openings, each closure member being movable outwardly from a closed to an open position, and roller means positioned in the garage structure so as to be operable to return any closures in open position to closed position whenever the door is moved from closed to open position.

2. Structure as defined in claim 1 wherein each closure member comprises a window sash and pane.

3. Structure as defined in claim 1 wherein each closure member projects outwardly from the outside of the garage door when it is moved from closed to open position.

4. Structure as defined in claim 1 together with a window screen positioned in each opening in spaced relation to the closure member for the opening.

5. Structure as defined in claim 1 together with a frame surrounding each of said openings, the closure member for the opening being hingedly connected to the frame, and means coacting with the frame and closure member for releasably retaining the member in both its closed and open positions.

6. In a garage structure, an overhead garage door comprised of a plurality of elongated sections hingedly connected to one another along their long edges, the door being movable between a substantially vertical closed position and a substantially horizontal open position, at least one of the door sections having a plurality of openings therethrough, a frame surrounding each opening, a closure member for each opening hingedly connected to its frame, each closure member being movable outwardly from a closed to an open position, means coacting with the frame and closure member for each opening to releasably retain the member in both its closed and open positions, and means positioned in the garage structure operable to automatically return any closures in open position to closed position whenever the door is moved from closed to open position.

7. Structure as defined in claim 6 wherein each closure member comprises a window sash and pane.

8. Structure as defined in claim 6 together with a window screen positioned in each opening frame is spaced relation to the closure member for the opening.

9. Structure as defined in claim 6 wherein the means for automatically returning closures in open position to closed position whenever the door is moved to open position are roller assemblies positioned in the garage structure.

* * * * *